US005870806A

United States Patent [19]

Black, Jr.

[11] Patent Number: 5,870,806

[45] Date of Patent: Feb. 16, 1999

[54] BISTABLE MEMBER FOR EJECTING SNAP FASTENER AND SPRING LATCH ASSEMBLIES

[76] Inventor: Robert P. Black, Jr., 18532 Paseo Pueblo, Saratoga, Calif. 95070

[21] Appl. No.: 44,691

[22] Filed: Mar. 18, 1998

[51] Int. Cl.[6] ..... A44B 17/00

[52] U.S. Cl. ..... 24/662; 24/102 A; 24/108; 24/464; 24/681; 411/353

[58] Field of Search ..... 24/662, 324, 681, 24/102 A, 102 E, 108, 129 D, 297; 411/512, 352, 353, 377, 372, 373, 431; 403/372

[56] References Cited

U.S. PATENT DOCUMENTS

| | | | |
|---|---|---|---|
| 2,623,311 | 12/1952 | Condon | 24/662 |
| 2,946,612 | 7/1960 | Ahlgren | 24/662 |
| 3,036,487 | 5/1962 | Hughes | 411/352 |
| 3,118,718 | 1/1964 | Babey | 411/353 |
| 4,557,654 | 12/1985 | Masuda et al. | 411/431 |
| 4,709,949 | 12/1987 | Umezawa et al. | 24/662 |
| 4,751,773 | 6/1988 | Nysten | 24/662 |
| 4,985,968 | 1/1991 | Hooper | 24/662 |
| 5,113,553 | 5/1992 | Hutchinson | 24/464 |

*Primary Examiner*—Victor N. Sakran
*Attorney, Agent, or Firm*—The Law Offices of Bever & Hoffman, LLP

[57] ABSTRACT

A bistable member including a bistable, invertable dish- or dome-shaped base portion and an engaging projection extending therefrom. A male member is engaged with the bistable member by pressing the male member against a central apex of the bistable member that is surrounded by the engaging projection, thereby inverting the bistable member from a first stable form to a second stable form. In the second stable form, the engaging protrusion and a portion of the bistable member wrap around a knob of the male member, thereby securing the male member to the bistable member. A subsequently applied triggering energy re-inverts the bistable member, thereby releasing the male member. This assembly is usable as a snap fastener by setting an equilibrium point of the bistable member such that a relatively large triggering energy is required to re-invert the bistable member. The assembly is also usable as a spring latch to propel projectiles (or an ejecting snap fastener to force open doors) by setting an equilibrium point of the bistable member such that a relatively small triggering energy is required to re-invert the female member, thereby applying a relatively large ejecting force to the projectile/door.

20 Claims, 7 Drawing Sheets

BISTABLE MEMBER FOR EJECTING SNAP FASTENER AND SPRING LATCH ASSEMBLIES

BACKGROUND OF THE INVENTION

1. Field of the Invention

The present invention relates to a bistable member usable, for example, in a snap fastener assembly or a spring latch assembly. The present invention also relates to assemblies incorporating the bistable member.

2. Description of the Prior Art

Snap fasteners employing resilient dish-shaped or curved-disk-shaped members are disclosed, for example, in U.S. Pat. Nos. 4,099,303 and 3,769,664 (Parera), U.S. Pat. No. 3,538,557 (Hirose) and U.S. Pat. No. 2,816,340 (Domenech et al.). In each of these references, the dish-shaped member is mounted on a female portion of the fastener, and includes hooks or protrusions mounted on legs extending from the peripheral edge of the member. When a male portion of the fastener is aligned with and pushed against the female portion, the dish-shaped member biases the legs such that the hooks/protrusions engage, for example, a slot formed in the male portion. Subsequently, when the male portion is pushed toward the female portion, the dish-shaped member is inverted, thereby disengaging the hooks/protrusions from the slot and causing the legs to rotate away from the male portion. This allows the released male portion to be separated from the female portion.

A significant drawback to the above-mentioned fastener structures arises because the force used to release the fastener is applied in the same direction as the force used to latch the fastener. This creates confusion because it is often unclear when the male portion is disengaged and may be separated from the female portion. Specifically, because the male portion is not forced away from the female portion when the fastener is released, it is difficult to detect when the male portion may be separated from the female portion.

A fastener addressing the above mentioned drawback is disclosed in U.S. Pat. No. 5,189,768 (Riceman et al.). This reference teaches the use of a spring located between the male and female portions that pushes the disengaged male portion away from the female portion. However, this fastener structure includes an even more complicated structure to incorporate the spring. In addition, as with the above-mentioned fastener structures, the force used to release the fastener is applied in the same direction as the force used to latch the fastener. Therefore, an operator must push against the resilient force exerted by the spring during both the releasing and latching operations.

Spring latches are mechanisms including a resilient member (such as an elastic rubber strap, spring or bow) that is restrained and triggered by a latching device to eject or propel a projectile. Toys and devices which eject/propel an article using such spring latches have been popular for centuries (e.g., crossbows, catapults, etc.). The resilient member stores potential energy during a relatively slow, typically manual arming process, and then quickly releases the potential energy to eject/propel the projectile with high velocity upon triggering by the latching device. A principle drawback of these devices is that the latching device must have sufficient strength to support the potential energy stored in the deformed, and therefore unstable, resilient member. To provide adequate support, the latching device is often bulky or made of high-cost materials, thereby constituting a substantial portion of the total cost of the device.

SUMMARY DESCRIPTION

The present invention is directed to a bistable member that stores potential energy when pressed by a male member, and releases the potential energy in response to a triggering force to eject the male member away from the bistable member. Because the triggering force is applied in the same direction as the ejection force, the bistable member avoids the problems associated with known snap fastener devices. Further, because the bistable member integrates both the latching mechanism and ejecting mechanism in a single molded structure, snap fastener and spring latch assemblies are economically produced with a minimum of parts.

The bistable member includes a continuously-curved base portion that is invertable from a non-inverted (first) stable form, in which a normally-convex surface thereof faces outward, into an inverted (second) stable form, in which the normally-convex surface becomes a concave surface. In one embodiment, the base portion is dome-shaped and has a central apex and a circular peripheral edge. The bistable member also includes an engaging protrusion (or series of protrusions) extending from the normally-convex surface of the base portion and located between the central apex and the peripheral edge. In the non-inverted stable form, the engaging protrusion forms a ring around the central apex that is wide enough to receive the head of a male portion. When the male portion is subsequently pressed against the central apex of the normally-convex surface, the base portion inverts from the non-inverted stable form to the inverted stable form. During this inversion process the engaging protrusion moves toward the central apex, thereby wrapping around and engaging the head of the male portion. The male portion is subsequently disengaged either by pulling the male portion away from the base portion, or by applying ejecting (triggering) energy to the temporarily-convex surface of the base portion, thereby causing the base portion to re-invert from the inverted stable form into the non-inverted stable form.

In accordance with an aspect of the present invention, a portion of the potential energy used to invert the bistable member is recovered when the base portion re-inverts. This recovered potential energy pushes the apex of the normally-convex surface toward the male member while the protrusion expands to its original non-inverted shape, thereby applying an ejecting (pushing) force on the male member. In snap fastener applications incorporating the bistable member, when the male member is manually pulled away from the bistable member, the ejection force exerted on the male member notifies the operator that separation from the bistable member is completed. In spring latch applications, when a relatively small triggering force is applied to the bistable member, a large portion of the potential energy stored in the base portion is used to propel a lightweight male member with high velocity, thereby providing several amusing applications.

BRIEF DESCRIPTION OF THE DRAWINGS

These and other features, aspects and advantages of the present invention will become better understood with regard to the following description, appended claims, and accompanying drawings, where:

DETAILED DESCRIPTION

Figure 1:
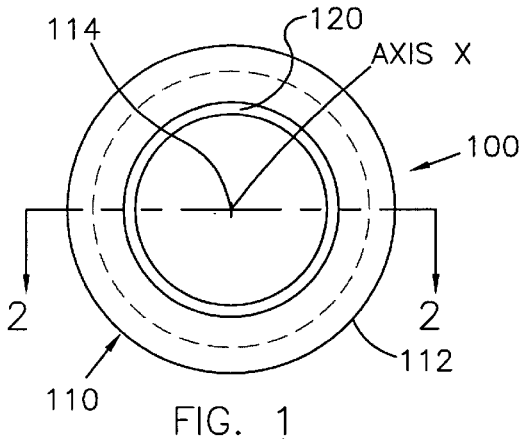
FIG. 1 is a top view of a bistable member in accordance with a first embodiment of the present invention.
Figure 2A:
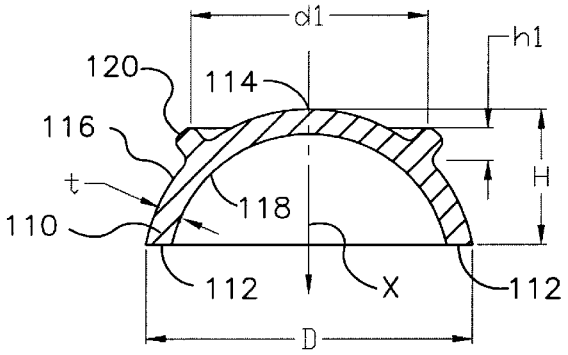
FIGS. 2A, 2B, 2C, 2D, 2E and 2F show side sectional views taken along section line 2—2 of the bistable member shown in FIG. 1.
Figure 2B:
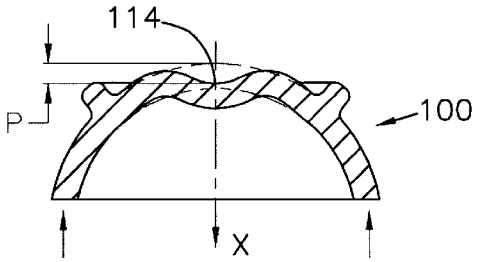
Figure 2C:
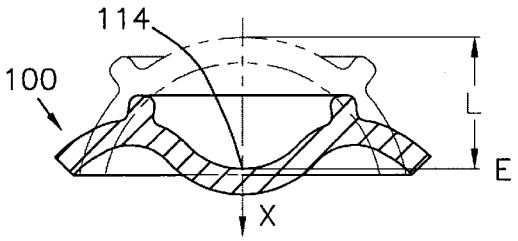
Figure 2D:
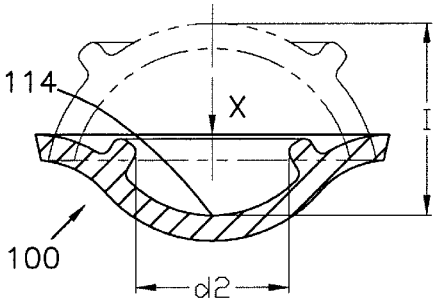
Figure 2E:
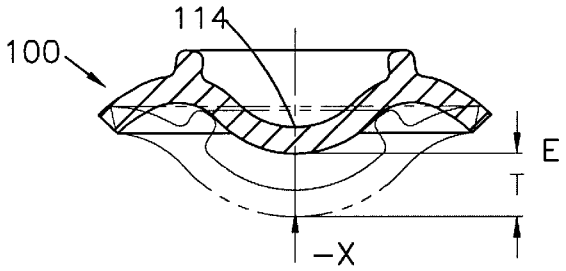

FIG. 1 shows a top view of a bistable member 100 in accordance with a first embodiment of the present invention. FIGS. 2A through 2F show side sectional views of the bistable member 100 taken along section line 2—2 of FIG. 1. In particular, FIG. 2A shows the bistable member 100 in a non-inverted (first) stable form, FIG. 2B shows the bistable member 100 in an unstable form, FIGS. 2C and 2E show the bistable member 100 at an equilibrium point, and FIG. 2D shows the bistable member 100 in an inverted (second) stable form.

Referring to FIGS. 1 and 2A, the bistable member 100 includes a base portion 110 and a ring-shaped engaging protrusion 120 extending from the base portion 110.

The base portion 110 is a dome- or dish-shaped (continuously-curved) structure that has a circular peripheral edge 112 surrounding a central apex 114. The base portion 110 includes a first (normally-convex) surface 116, and an opposing second (normally-concave) surface 118. The base portion 110 has a diameter D defined by the peripheral edge 112, a height H measured from the apex 114 to a plane defined by the peripheral edge 112 (along a central axis X), and a thickness t measured between the first surface 116 and the second surface 118.

The base portion 110 is formed from a resilient material such as rubber, plastic, spring steel, or a combination of two or more such materials. The diameter D, height H and thickness t of the base portion 110 are determined in part upon the selected material, and in part upon the particular application in which the bistable member 100 is utilized. In typical applications, the dimensions are selected such that inversion (as described below) will not rupture, crack or permanently deform the selected resilient material. For example, for a particular material having a thickness t, the diameter-to-height ratio (D/H) ratio of the base portion 110 may be selected for frequent inversion between the first stable form (shown in FIG. 2A) and an inverted (second) stable form (shown in FIG. 2D). This operation is achieved by forming the bistable member 100 from, for example, rubber having a diameter D of approximately 1.15 inches, a height H of approximately 0.86 inches, and a thickness t of approximately 0.18 inches. In other applications the base portion may be designed to permanently deform (i.e., become locked in the inverted state). The particular bistable member dimensions for a given application can be determined through routine experimentation.

Referring again to FIGS. 1 and 2A, the ring-shaped engaging protrusion 120 extends from the first surface 116 of the base portion 110, and is centered on the apex 114 at a radius r1. The engaging protrusion 120 is an annular rib that has a height h1 measured from the first surface 116 of the base portion 110, and is integrally molded with the base portion 110. When the bistable member 100 is in the non-inverted shape, the engaging protrusion 120 has an inner diameter d1. The non-inverted diameter d1 and height h1 of the engaging protrusion 120 are selected to correspond with the shape and size of a male member (discussed below) latched by the bistable member 100.

Figure 3:
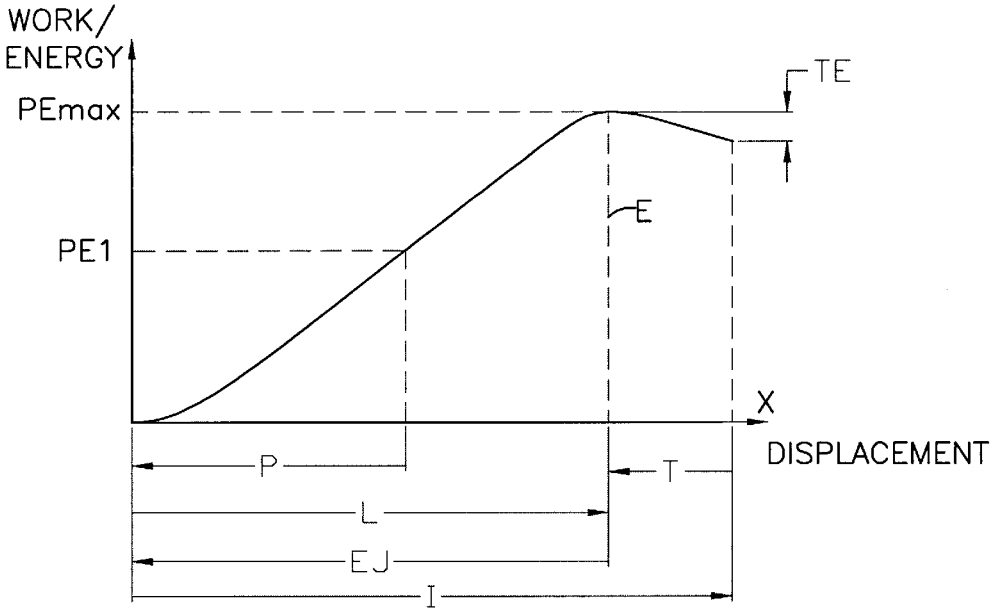
FIG. 3 is a graph showing the work/energy versus displacement characteristics of the bistable member in accordance with the first embodiment.

FIG. 3 is a graph showing the potential energy stored in the bistable member 100 versus the displacement of apex 114 along the X-axis. This graph is referred to in the following description of the inversion process as the bistable member 100 is inverted from the first stable form (FIG. 2A) and the second stable form (FIG. 2E).

Referring to FIG. 2B, a loading force sufficient to displace the apex 114 an arbitrary distance P is applied to the bistable member 100 in a direction along the X-axis. As shown by the curve in FIG. 3, the work required to displace the apex 114 over the distance P is stored in the bistable member 100 as potential energy PE1. Assuming point P is reached before an equilibrium (switch-over) point of the bistable member 100, if the loading force were subsequently removed at point P, the potential energy PE1 would return the bistable member 100 to the first (non-inverted) shape.

Referring to FIG. 2C, as the loading force is applied over a further distance, the bistable member 100 reaches an equilibrium point E. The work required to reach the equilibrium point from the first (non-inverted) shape is equal to the loading force applied over a distance L, and is referred to herein as the latching energy. As shown in FIG. 3, the bistable member 100 stores a maximum potential energy $PE_{max}$ at the equilibrium point E. If the apex 114 is displaced beyond the equilibrium point E, the bistable member 100 becomes unstable, and some of the stored potential energy $PE_{max}$ is exerted to invert the bistable member 100 into the inverted (latched) shape shown in FIG. 2D. In this inverted shape, the apex 114 is displaced in the X direction from its original position by an inverted distance I.

Figure 2F:
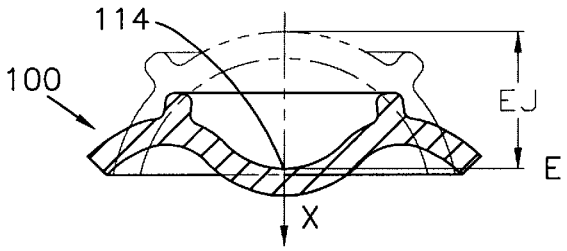

Referring to FIGS. 2E and 2F, the bistable member is re-inverted from the inverted form in response to a triggering force applied to the apex 114 in the negative X-axis direction. The work required to reach the equilibrium point from the inverted shape is equal to this triggering force applied over a distance T, and is referred to herein as the triggering energy TE. FIG. 3 shows that as the bistable member 100 passes through the equilibrium point E, the stored potential energy causes the apex 114 to rapidly displace in the negative X-axis direction over an ejection distance EJ until the bistable member 100 re-inverts to the non-inverted shape shown in FIG. 2A. The potential energy expended over the distance EJ is referred to herein as the ejecting energy.

Figure 4:
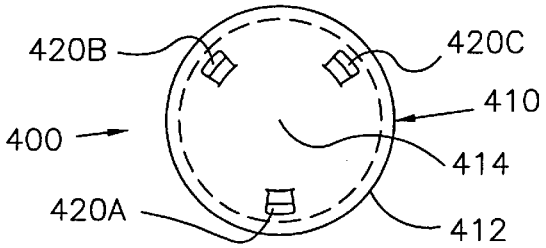
FIG. 4 shows a top view of a bistable member in accordance with a second embodiment of the present invention.

FIG. 4 shows a top view of a bistable member 400 according to a second embodiment of the present invention. The bistable member 400 differs from the bistable member 100 of the first embodiment in that, instead of the continuous engaging protrusion 120, the engaging structure includes spaced-apart portions 420A, 420B and 420C. Similar to the engaging protrusion 120, the spaced-apart portions 420A, 420B and 420C are centered on an apex 414, and are located between a peripheral edge 412 and the apex 414. Similar to the engaging protrusion 120, the spaced-apart portions 420A, 420B and 420C may be integrally molded with the base portion 410, or may be attached using an appropriate adhesive. By separating the engaging structure into spaced-apart portions 420A, 420B and 420C, a lower latching energy is required to invert the bistable member 400 (in comparison to the latching energy required to invert the bistable member 100 of the first embodiment).

Figure 5A:
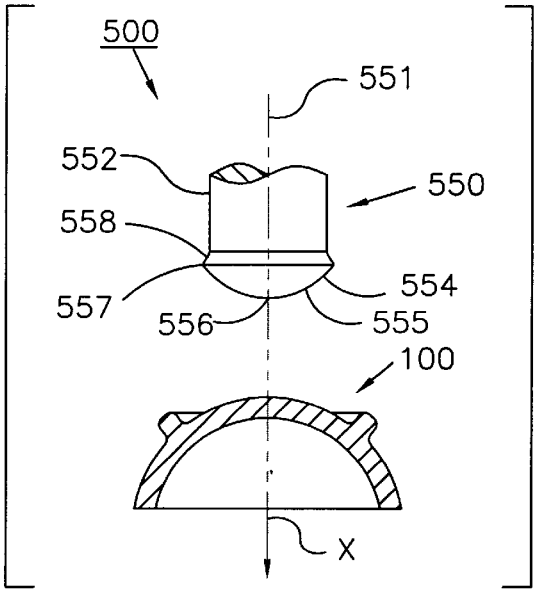
FIGS. 5A, 5B, 5C and 5D show sectional side views of an assembly in accordance with the present invention.

FIG. 5A shows a sectional side view of an assembly 500 including the bistable member 100 and a male member 550. Although the bistable member 100 is identified in the following description, the bistable member 100 may be replaced by the bistable member 400 (described above).

Referring to FIG. 5A, the male member 550 includes a relatively narrow-diameter shaft 552 and a knob 554 that are symmetric about a longitudinal axis 551. The knob 554 includes a dome or semi-spherical face 555 having an apex 556 and an outer edge 557, and a conical neck 558 extends from the edge 557 to the outer surface of the shaft 552. The male member 550 is formed, for example, from rubber, plastic, metal or a combination thereof in accordance with the embodiment to which the assembly is directed.

Figure 5B:
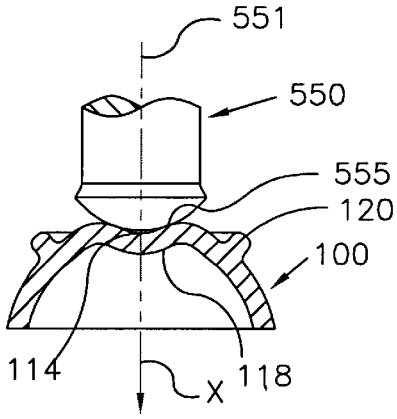
Figure 5C:
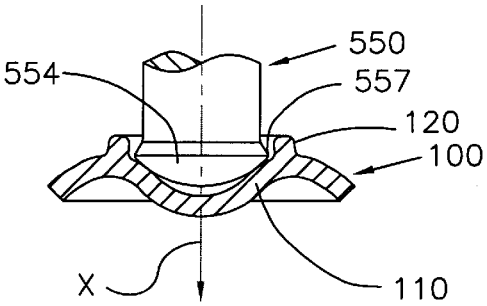
Figure 5D:
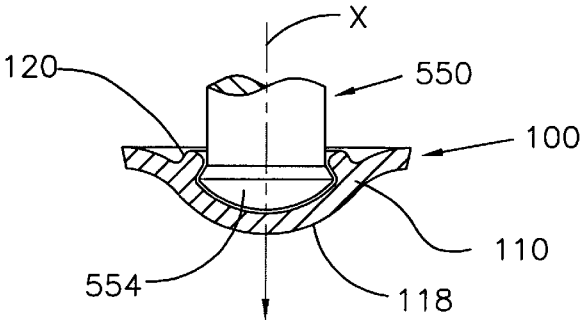

FIGS. 5B through 5D illustrate a latching process by which the male member 550 is engaged by the bistable member 100 in accordance with the present invention. The latching process is most easily accomplished by pressing the male member 550 against the bistable member 100 while restraining the peripheral edge 112 of the base portion 110. However, a similar inversion process is achievable by applying a pulling force to the normally-convex surface 118 of the base member 110.

Referring to FIG. 5B, the male member 550 is positioned adjacent the bistable member 100 with the axis 551 of the male member 550 generally aligned with the X-axis of the bistable member 100. The male member 550 is then moved along the X-axis such that the face 555 presses against the apex 114 of the bistable member 100. In response to the pressing force applied by the face 555 against the apex 114, the base portion 110 of the bistable member 100 begins to collapse, causing the engaging protrusion 120 to turn inward (i.e., toward the male member 550).

As shown in FIG. 5C, when a latching energy sufficient to invert the bistable member 100 is applied by the male member 550, the base portion 110 deforms to the equilibrium point. As the base portion 110 deforms, the engaging protrusion 120 is forced further inward toward the male member 550. As the bistable member 100 passes through the equilibrium point, the engaging protrusion 120 closes behind the knob 554. That is, at the beginning of the latching process, the engaging protrusion 120 defined an opening d1 (see FIG. 2A) that is equal to or larger than the diameter of the outer edge 557 of the knob 554, thereby allowing the knob 554 to enter the opening. As the latching process proceeds, the engaging protrusion 120 is forced inward to define a second opening d2 (see FIG. 2D) that is smaller than the diameter defined by the outer edge 557, thereby closing behind the knob 554.

Finally, as shown in FIG. 5D, when the bistable member 100 is fully inverted, the engaging protrusion 120 rotates around the knob 554 of the male member 550, thereby capturing it. Specifically, the engaging protrusion 120 and a part of the base portion 110 adjacent to the apex 114 form a latching mechanism that prevent dislocation of the male member 550.

The male member 550 may remain latched to the bistable member 100 for an indefinite period. When separation is desired, a triggering energy is required to re-invert the bistable member 100 in order to release the male member 550 from the latching mechanism. This triggering energy is applied by pulling the male member 550 along the X-axis, or by pushing on the normally-convex surface 118 of the inverted base portion 110. In either case, the triggering energy is applied in the same direction in which the male member 550 is removed, thereby making the separation process obvious to an operator.

The assembly 500 of the present invention is greatly simplified over prior art devices because the engaging protrusions 120 are integrally formed on the normally-concave surface 116 to form the latching mechanism for retaining the male member 550. That is, the latching structure is integral to the base portion 110, and utilizes both the engaging protrusion 120 and a portion of the inverted base portion 110 to retain the male member 550. This simplifies the resulting assembly because the bistable member 100 can be molded and assembled as a single part.

The assembly 500 in accordance with the present invention has a broad range of applications. The assembly 500 may be used to produce unique, simple, reliable, and economical devices for fastening/latching a first structure (attached to the bistable member) to a second structure (attached to the male member). Alternatively, the assembly may be used to produce spring latch devices by utilizing the male member to a projectile. The benefits and advantages of these and other applications will become apparent with reference to the energy/displacement graphs shown in FIGS. 6A and 6B, and to the exemplary embodiments discussed below.

Figure 6A:
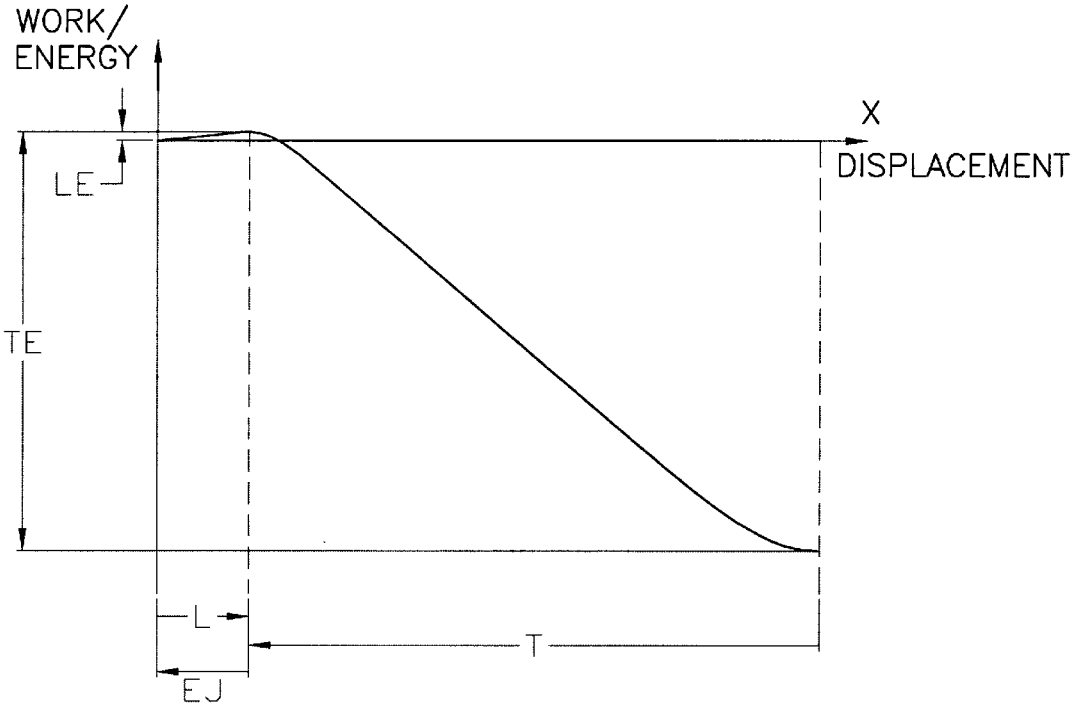
FIGS. 6A and 6B are graphs showing the work/energy versus displacement characteristics associated with different applications including the assembly of the present invention.
Figure 6B:
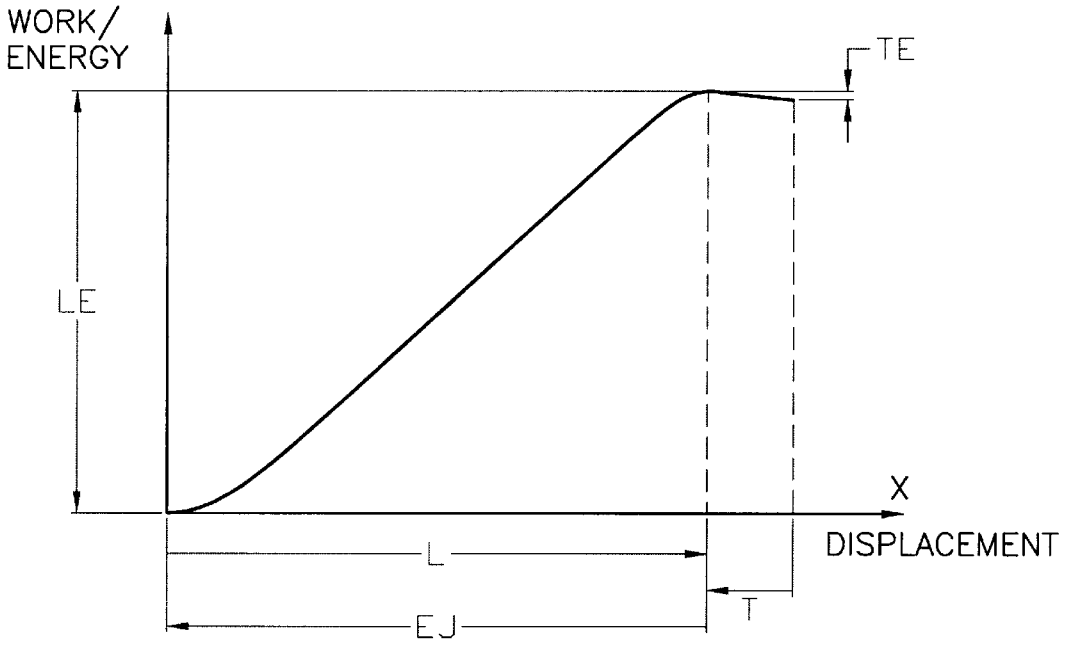

FIGS. 6A and 6B are graphs showing the work/energy versus displacement characteristics associated with possible applications of the present invention. FIG. 6A shows a first energy/displacement graph associated with a first bistable member in which the triggering energy TE is greater than the latching energy LE. An assembly incorporating such a bistable member may be used, for example, to produce low cycle snap fasteners that are simple, economical and able to accommodate large tolerances. FIG. 6B shows a second energy/displacement graph associated with a second bistable member in which the latching energy is greater than the triggering energy. An assembly incorporating such a bistable member may be used, for example, to produce economical high cycle snap fasteners that require a simple and effective means to restrain along with the additional benefit of an ejecting/releasing action in response to a relatively small triggering force. This bistable member may also be used to produce spring latch devices that eject a projectile. This ejecting/releasing action is possible because such a bistable member returns most of the work exerted during the latching process as ejecting energy simply by moving the base member back a short distance T to its equilibrium point.

FIGS. 7A through 7D show sectional side views of a snap fastener assembly 700 in accordance with an exemplary embodiment of the present invention.

Figure 7A:
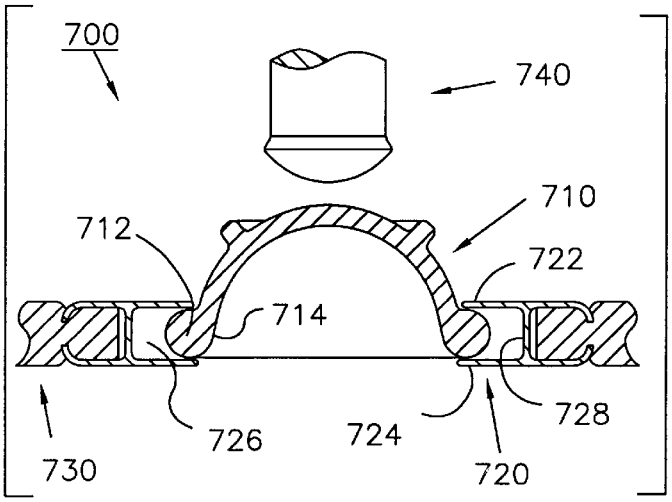
FIGS. 7A, 7B, 7C and 7D show sectional side views of a first snap fastener assembly according to the present invention.

Referring to FIG. 7A, the snap fastener assembly 700 includes a bistable member 710 that is slidably maintained in a bracket 720, a first host structure 730 fixedly connected to the bracket 720, and a male member 740 that is connected to a second host structure (not shown).

The bistable member 710 includes a stiffened rib 712 formed on surrounding the peripheral edge 714. The rib 712 provides smooth sliding and resists detachment of the bistable member 710 from the bracket 720. The bistable member 710 is otherwise substantially identical to the bistable member 100 (discussed above).

The bracket 720 is a circular member including first disk 722 and a second disk 724 cooperatively defining a slot 726 therebetween, and a cross member 728 connecting the first and second disks 722 and 724. The first and second disks define central openings for receiving the bistable member 710. The rib 712 of the bistable member 710 is slidably received in the slot 726. The outer peripheral edges of the first and second disks are crimped to fasten the bracket 720 to the first host structure 730, which is formed, for example, from a rigid material such as stainless steel.

Figure 7B:
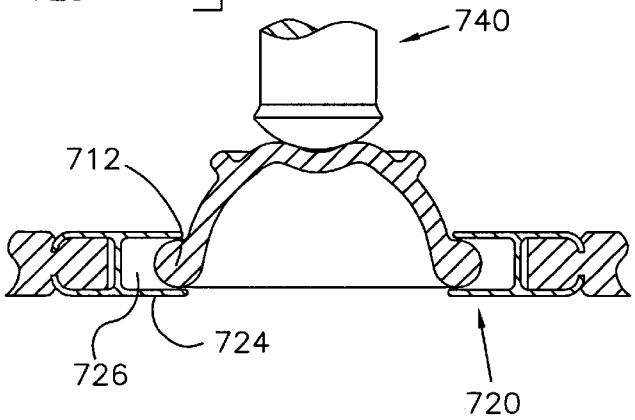
Figure 7C:
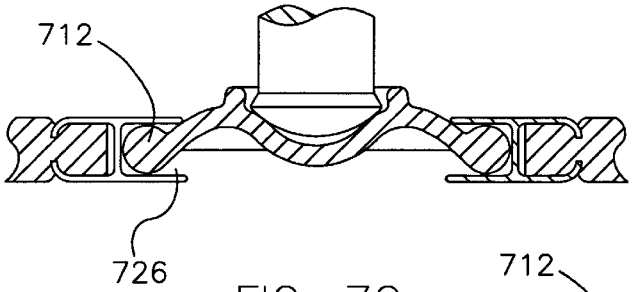
Figure 7D:
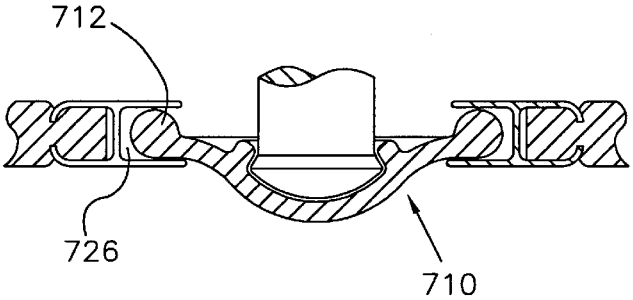

FIGS. 7B through 7D illustrate a latching process whereby the second host structure connected to the male member 740 is fastened to the first host structure 730, which can be a material such as cloth, or a rigid sheet of plastic or metal. In particular, as the male member 740 is pressed against the resilient member 710, the bistable member 710 is pressed against the bracket 720. This pressing force is resisted by the second disk 724, thereby causing deformation of the resilient member (FIG. 7B). As this deformation increases, the rib 712 of the bistable member 710 is forced outward along the slot 726 (FIG. 7C). Finally, when sufficient latching energy is exerted by the male member 740, the bistable member 710 inverts, causing the rib 712 to slide back in the slot 726 toward the central opening. Other details of the latching process and the subsequent re-inversion (triggering) process are substantially the same as those provided above, and are omitted for brevity.

Figure 8A:
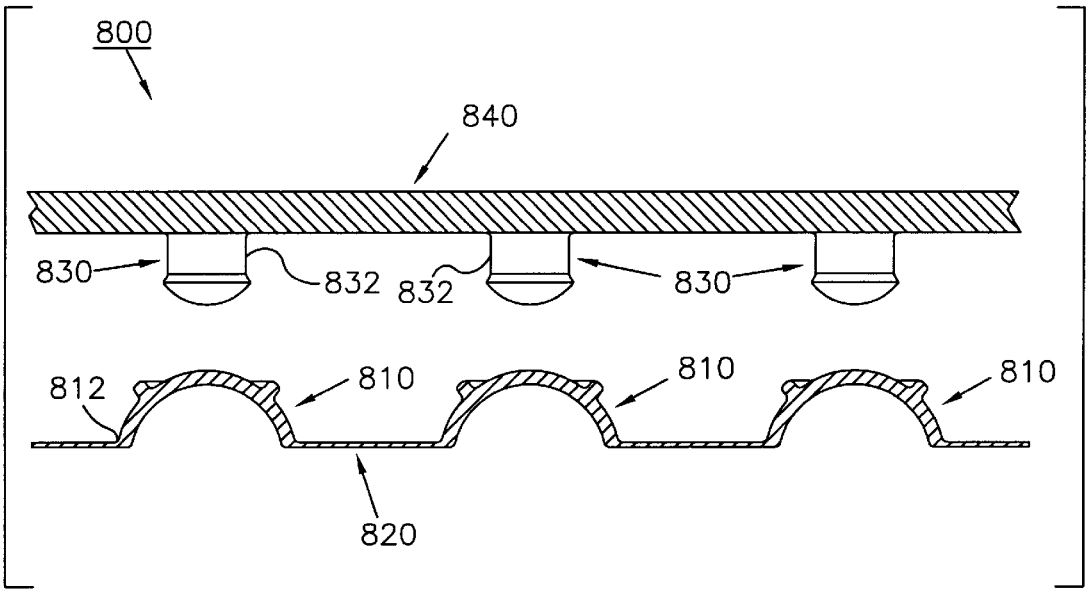
FIGS. 8A and 8B show sectional side views of a second snap fastener assembly according to the present invention.
Figure 8B:
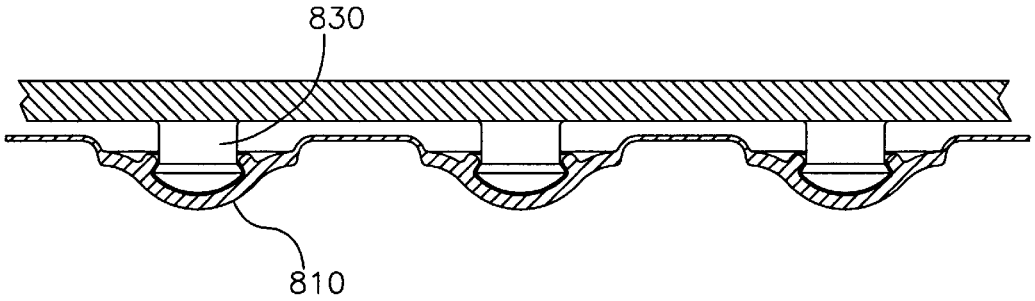

FIGS. 8A and 8B show sectional side views of a snap fastener assembly 800 according to a second exemplary embodiment of the present invention.

Referring to FIG. 8A, the snap fastener assembly 800 includes a plurality of bistable members 810 that are connected to a first host structure 820, and a male member 830 that is integrally connected to a second host structure 840.

The peripheral edges 812 of the bistable members 810 are integrally connected to the first host structure 820, which is, for example, a fabric sheet or a flexible plastic or rubber, or spring steel sheet. The bistable member 810 is otherwise substantially identical to the bistable member 100 (discussed above). Likewise, the shaft 832 of each male member 830 is fixedly connected to the second host structure 840, which is, for example, a flexible fabric material or a rigid sheet of wood or metal.

FIG. 8B illustrates the snap fastener assembly 800 in a latched condition wherein the male members 830 are latched by the bistable members 810, thereby fastening the first host structure 820 to the second host structure 840. The latching and subsequent disengaging (triggering) processes are substantially the same as those provided above, and are omitted for brevity.

Figure 9A:
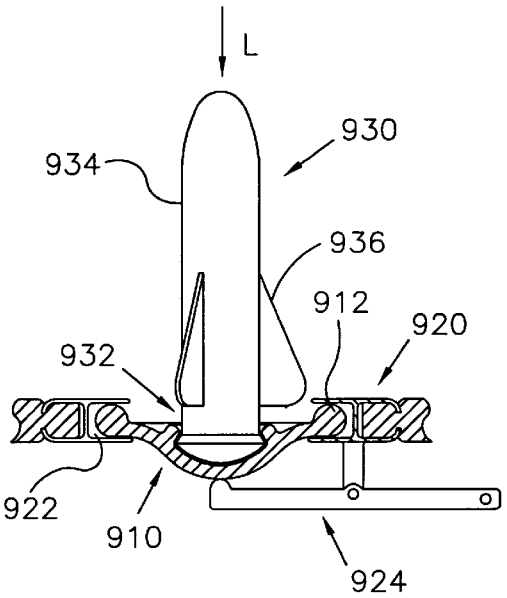
FIGS. 9A and 9B show sectional side views of a spring latch assembly according to the present invention.
Figure 9B:
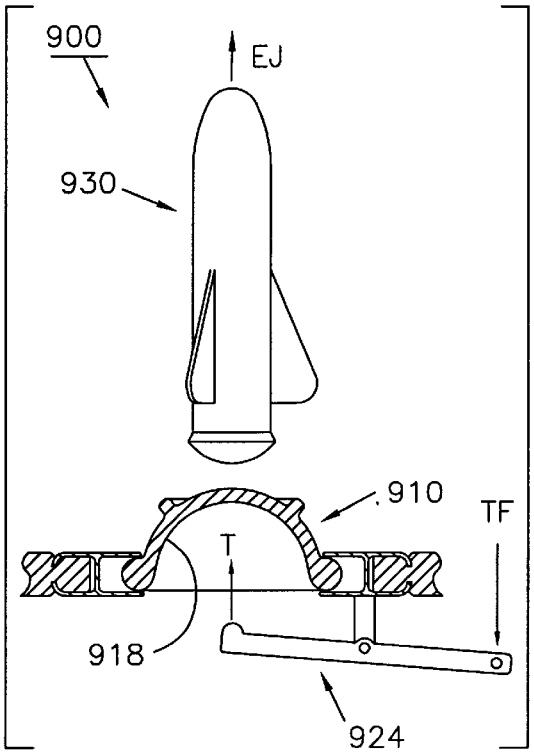

FIGS. 9A and 9B show sectional side views of a spring latch assembly 900 according to a third exemplary embodiment of the present invention.

Referring to FIG. 9A, the snap fastener assembly 900 includes a bistable member 910 that is mounted on a launching structure 920, and a projectile 930 that is latched by the bistable member 910.

The peripheral edge 912 of the bistable member 910 is slidably received in a slot 922 of the launching structure 920. The bistable member 910 is otherwise substantially identical to the bistable member 100 (discussed above). The launching structure 920 includes a lever 924 that transmits triggering energy to the bistable member 910. The projectile 930 includes an engaging portion 932 that is substantially identical to the male member 550 of FIG. 5, and further includes a body 934 and fins 936 for facilitating stable flight.

FIG. 9B illustrates the snap fastener assembly 900 after a triggering force TF is applied to the lever 924. As indicated, the triggering energy generated by the triggering force TF is transmitted to the bistable member 910, thereby causing the bistable member 910 to re-invert. The bistable member 910 is constructed such that it has energy/displacement characteristics similar to those shown in FIG. 6B, whereby a relatively small triggering energy is required to re-invert the bistable member 910, and a relatively large ejecting force is thereafter transmitted to the projectile 930. As a result, the projectile 930 is ejected upward with significant velocity, thereby providing amusement. The latching and subsequent launching (triggering) processes are substantially the same as those provided above, and are omitted for brevity.

Although the spring latch assembly 900 utilizes a lever 924 to apply the triggering force, other triggering methods may be employed. For example, a pushing triggering force can be applied by dropping the inverted assembly with the projectile 930 pointed upward and the second (normally-convex) surface 918 of the bistable member 910 facing downward. The impact provides enough energy to push the bistable member 910 through the equilibrium point, thereby releasing the projectile 930 and propelling it upward. This actuation can also be initiated by multiple means such as pushing on the convex side of the inverted bistable member 910 with a push rod or some other device.

Although the present invention has been described in considerable detail with reference to certain preferred embodiments thereof, the bistable member may be modified to cover a broad range of applications not disclosed herein. Some of these possible modifications are discussed in the following paragraphs.

As suggested above, the basic function of the disclosed bistable member and assembly is easily changed by altering the cross-section and/or material of the bistable member to get a different behavior to produce additional applications. For example, the bistable member may be designed such that the base portion material yields as it passes through the equilibrium point, thereby producing a low cycle, swaged, or one time use connector. This additional example further suggests that the bistable member and assembly according to the present invention may be of great benefit to a wide variety of industries.

Figure 10A:
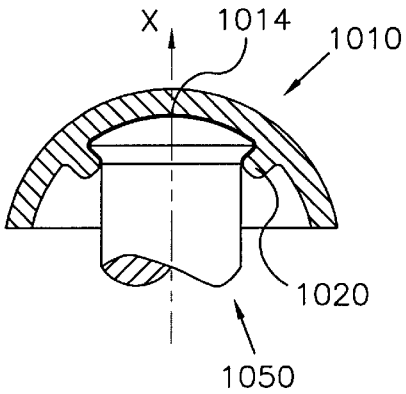
FIGS. 10A and 10B show sectional side views of a second assembly according to the present invention.
Figure 10B:
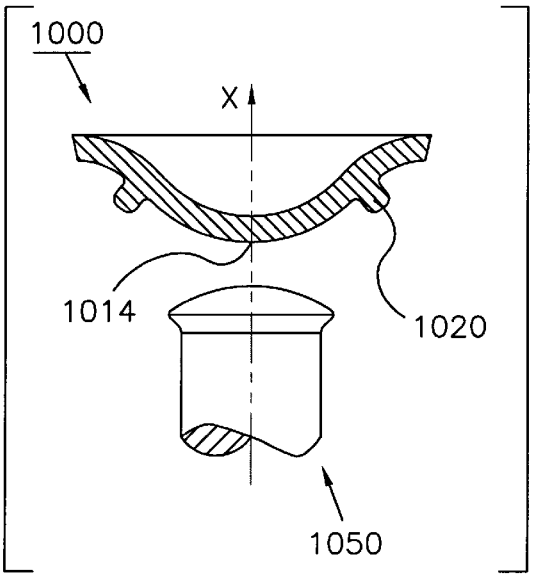

FIGS. 10A and 10B show an assembly 1000 illustrating another alternative embodiment of the present invention. The assembly 1000 includes a bistable member 1010 that is formed with a ring-shaped engaging protrusion 1020 extending from its normally-concave surface, instead of the normally-convex surface as in the embodiments described above. With this modification, the bistable member 1010 is in a non-inverted shape when a male member 1050 is engaged by engaging protrusion 1020 and held against an apex 1014 located on the normally-concave surface (shown in FIG. 10A). Conversely, bistable member 1010 enters an inverted shape when male member 1050 is disengaged (as shown in FIG. 10B). That is, the bistable member 1010 is inverted from the first (inverted) stable form into a second (non-inverted) stable form when the male member 1050 is pressed against the apex 1014 in the positive X direction. This arrangement may be beneficial in certain latching applications wherein a large triggering (disengaging) force is desirable.

Further, a ball or other projectile may replace the male member in certain spring latch applications.

The above examples suggest that alternative embodiments and applications, in addition to those disclosed herein, are possible. Therefore, the spirit and scope of the appended claims should not be limited to the description of the preferred embodiments contained herein.

I claim:

1. A bistable member comprising:

a continuously-curved base portion formed from a resilient material and having a circular outer edge and a central apex, the base member having opposing first and second surfaces; and an engaging protrusion fixedly connected to and protruding from the first surface between the apex and the outer edge, the engaging protrusion defining an opening;

wherein the base portion is invertable from a first stable form to a second stable form, and wherein the opening defined by the engaging protrusion when the base portion is in the first stable form has a first diameter when the base portion is in the first stable form, and a second diameter when the base portion is in the second stable form, the first diameter being different from the second diameter.

2. The bistable member according to claim 1, wherein, in the first stable form, the first surface defines a convex surface of the base portion and the second surface defines a concave surface of the base portion, and in the second stable form, the first surface defines the concave surface of the base portion and the second surface defines the convex surface of the base portion.

3. The bistable member according to claim 1, wherein the base portion and the engaging protrusion are rubber, and wherein the engaging structure is integrally molded with the base portion.

4. The bistable member according to claim 1, wherein the engaging protrusion is an annular rib surrounding the central region of the first surface.

5. The bistable member according to claim 1, wherein the engaging protrusion comprises a plurality of separate sections surrounding the central region of the first surface.

6. An assembly comprising:

a bistable member including:

a dish-shaped base portion formed from a resilient material and having opposing first and second surfaces, the first surface including a central apex, and an engaging protrusion extending from the first surface; and a male member including a knob;

wherein the bistable member is inverted from a first stable form to a second stable form when the knob of the male member is pressed against the central apex of the base portion with a predetermined latching force; and wherein the knob of the male member is in contact with and is held between the central apex of the base portion and the engaging protrusion when the bistable member is inverted into the second stable form.

7. The assembly according to claim 6, wherein, in the first stable form, the first surface defines a convex surface of the base portion and the second surface defines a concave surface of the base portion, and in the second stable form, the first surface defines the concave surface of the base portion and the second surface defines the convex surface of the base portion.

8. The assembly according to claim 6, wherein the base portion and the engaging protrusion are rubber, and wherein the engaging structure is integrally molded with the base portion.

9. The assembly according to claim 6, wherein the engaging protrusion is an annular rib surrounding the central region of the first surface.

10. The assembly according to claim 6, wherein the engaging protrusion comprises a plurality of separate sections surrounding the central region of the first surface.

11. The assembly according to claim 6, wherein a latching energy required to invert the bistable member from the first stable form to the second stable form is greater than a triggering energy required to re-invert the bistable member from the second stable form to the first stable form.

12. The assembly according to claim 6, wherein a latching energy required to invert the bistable member from the first stable form to the second stable form is less than a triggering energy required to re-invert the bistable member from the second stable form to the first stable form.

13. A snap fastener assembly comprising:

a host structure;

a plurality of bistable members mounted on the host structure, each bistable member including:

a dish-shaped base portion formed from a resilient material and having opposing first and second surfaces, the first surface including a central apex, and an engaging protrusion extending from the first surface; and a plurality of male members, each male member including a knob;

wherein each of the plurality of bistable members is inverted from a first stable form to a second stable form when the knob of an associated one of the plurality of male members is pressed against the central apex of the base portion with a predetermined latching force; and wherein the knob of each male member is in contact with and is held between the central apex of the base portion and the engaging protrusion of an associated bistable member when the associated bistable member is inverted into the second stable form.

14. The snap fastener assembly according to claim 13, wherein, in the first stable form, the first surface of each bistable member defines a convex surface of the base portion and the second surface defines a concave surface of the base portion, and in the second stable form, the first surface defines the concave surface of the base portion and the second surface defines the convex surface of the base portion.

15. The snap fastener assembly according to claim 13, wherein the base portion and the engaging protrusion of each bistable member are rubber, and wherein the engaging structure is integrally molded with the base portion.

16. The snap fastener assembly according to claim 13, wherein the engaging protrusion of each bistable member is an annular rib surrounding the central region of the first surface.

17. The snap fastener assembly according to claim 13, wherein the engaging protrusion of each bistable member comprises a plurality of separate sections surrounding the central region of the first surface.

18. The snap fastener assembly according to claim 13, wherein a latching energy required to invert each of the plurality of bistable members from the first stable form to the second stable form is less than a triggering energy required to re-invert the bistable member from the second stable form to the first stable form.

19. The snap fastener assembly according to claim 13, further comprising a plurality of brackets, each bracket connected between one of the plurality of bistable members and the host structure, wherein a peripheral edge of said one of the plurality of bistable members is slidably engaged in a slot formed in said each bracket.

20. The snap fastener assembly according to claim 13, wherein said plurality of bistable members are integrally molded with the host structure.

* * * * *